US006562770B2

(12) United States Patent
Pashkovski et al.

(10) Patent No.: US 6,562,770 B2
(45) Date of Patent: May 13, 2003

(54) FRAGRANCE-CONTAINING GEL FOR DELIVERING FRAGRANCE FROM STRUCTURED LIQUID DETERGENT COMPOSITIONS

(75) Inventors: Evgueni E. Pashkovski, Bridgewater, NJ (US); Amjad Farooq, Somerville, NJ (US); Marija Heibel, Highland Park, NJ (US); Ammanuel Mehreteab, Piscataway, NJ (US); Lynne Miller, Sayerville, NJ (US); Jeff Mastrull, Middlesex, NJ (US); Richard Theiler, Bridgewater, NJ (US)

(73) Assignee: Colgate-Palmolive Co., New York, NY (US)

( * ) Notice: Subject to any disclaimer, the term of this patent is extended or adjusted under 35 U.S.C. 154(b) by 0 days.

(21) Appl. No.: 09/818,707

(22) Filed: Mar. 27, 2001

(65) Prior Publication Data

US 2003/0032564 A1 Feb. 13, 2003

(51) Int. Cl.[7] ..... C11D 3/37; C11D 3/50
(52) U.S. Cl. ..... 510/101; 510/476
(58) Field of Search ..... 510/101, 475, 510/476

(56) References Cited

U.S. PATENT DOCUMENTS

| | | | | |
|---|---|---|---|---|
| 2,674,619 A | | 4/1954 | Lundsted | 260/485 |
| 2,798,053 A | | 7/1957 | Brown | 260/2.2 |
| 3,114,603 A | | 12/1963 | Howell | 23/113 |
| 3,915,921 A | | 10/1975 | Schlatzer, Jr. | 260/17.4 |
| 4,509,949 A | | 4/1985 | Huang et al. | 586/558 |
| 4,686,254 A | | 8/1987 | Lochhead et al. | 524/99 |
| 5,004,598 A | | 4/1991 | Lochhead et al. | 424/59 |
| 5,362,413 A | * | 11/1994 | Kaufmann et al. | 252/174 |
| 5,585,104 A | | 12/1996 | Ha et al. | 424/401 |
| 6,019,855 A | * | 2/2000 | Finch et al. | 134/42 |
| 6,027,719 A | * | 2/2000 | Tomura et al. | 424/78.02 |
| 6,194,370 B1 | | 2/2001 | Williams, Jr. et al. | 510/320 |

FOREIGN PATENT DOCUMENTS

| | | | |
|---|---|---|---|
| DE | 19910788 | | 9/2000 |
| EP | 0268164 | | 12/1993 |
| JP | 5-220206 | * | 8/1993 |
| WO | 9803621 | | 2/1998 |
| WO | 0116262 | | 3/2001 |

* cited by examiner

*Primary Examiner*—John Hardee
(74) *Attorney, Agent, or Firm*—Bernard Lieberman

(57) ABSTRACT

A stable fragrance-containing gel is provided which is capable of being mixed with a fragrance-free base composition comprised of a homogeneous aqueous structured liquid detergent composition to form a pourable fragrance-containing homogeneous aqueous structured detergent composition. The resulting structured detergent composition provides enhanced deposition and longevity of fragrance upon fabrics laundered with such fragrance-containing detergent composition as compared to laundering with an otherwise identical composition containing the same level of fragrance but in the absence of said fragrance-containing gel, said fragrance-containing gel comprising:

(a) a polyacrylic acid polymer having an average particle size below about 1 mm;

(b) water in an amount sufficient to form a gel with said polymer;

(c) a fragrance dispersed within said gel; and (d) a nonionic surfactant in an amount sufficient to emulsify said fragrance and enhance its dispersion within said gel to provide a stable fragrance-containing gel.

13 Claims, No Drawings

FRAGRANCE-CONTAINING GEL FOR DELIVERING FRAGRANCE FROM STRUCTURED LIQUID DETERGENT COMPOSITIONS

This invention relates to a fragrance-containing gel capable of being mixed with and delivering fragrance from an aqueous structured liquid detergent composition. More importantly, this invention relates to a stable fragrance-containing gel and to a fragrance-containing homogeneous aqueous structured liquid detergent composition which contains said gel and which is characterized by its ability to provide enhanced deposition of such fragrance upon fabrics laundered therewith.

BACKGROUND OF THE INVENTION

The addition of perfume to a liquid detergent composition to impart a pleasing aroma or fragrance to such detergent composition is well-known in the art. The presence of perfume provides an aesthetic benefit to the consumer upon use of the detergent composition and generally serves as a signal of freshness and cleanliness for laundered fabrics which contain a pleasing fragrance. However, notwithstanding the enhanced aroma of the detergent composition itself, relatively little of the perfume fragrance is imparted to fabrics during laundering. Primarily, this is because the perfume ingredients in the liquid composition are rapidly dispersed and diluted during laundering in the aqueous wash and rinse waters. Consequently, only a relatively limited amount of the perfume is available to contact the fabrics during washing, the major portion of the perfume being drained from the washing machine with the wash solution. There remains, therefore, a need in the art to improve the effectiveness of delivering perfume from a detergent composition to washed fabrics and to enhance the longevity of such fragrance on the fabrics.

SUMMARY OF THE INVENTION

The present invention provides a stable fragrance-containing gel capable of being mixed with a fragrance-free base composition comprised of a homogeneous aqueous structured liquid detergent composition to form a pourable fragrance-containing homogeneous aqueous structured detergent composition which is characterized by being able to provide enhanced deposition and retention of said fragrance upon fabrics laundered with such fragrance-containing detergent composition as compared to laundering with an otherwise identical composition containing the same level of fragrance but in the absence of said fragrance-containing gel, said fragrance-containing gel comprising:

(a) a polyacrylic acid polymer having an average particle size below about 1 mm;

(b) water in an amount sufficient to form a gel with said polymer;

(c) a fragrance dispersed within said gel; and (d) a nonionic surfactant in an amount sufficient to emulsify said fragrance and enhance its dispersion within said gel to provide a stable fragrance-containing gel.

There is also provided in accordance with the present invention a fragrance-containing homogeneous aqueous structured liquid detergent composition which is capable of providing enhanced deposition of fragrance upon fabrics laundered with such detergent composition comprising:

(a) a homogeneous structured liquid detergent composition; and (b) a stable fragrance-containing gel comprising (i) a polyacrylic acid polymer having an average particle size below about 1 mm; (ii) water in an amount sufficient to form a gel with said polymer; (iii) a fragrance dispersed within said gel; and (iv) a nonionic surfactant in an amount sufficient to emulsify said fragrance and enhance its dispersion within said gel to provide a stable fragrance-containing gel, whereby said liquid detergent composition is able to provide enhanced deposition of fragrance upon laundered fabrics as compared to laundering with an otherwise identical composition containing the same level of fragrance but in the absence of said fragrance-containing gel.

The polyacrylic acid polymer is preferably at least partly neutralized either in-situ or during preparation.

In accordance with the method aspect of the invention there is provided a method of laundering fabrics comprising the step of contacting such fabrics with an effective amount of the fragrance-containing homogeneous aqueous structured liquid detergent composition defined above.

There is also provided a method of preparing a fragrance-containing gel comprising in sequence the steps of:

(a) providing a polyacrylic acid polymer having an average particle size below about 1 mm;

(b) adding said polyacrylic acid polymer to water with mixing to form a uniform dispersion of said polymer in water;

(c) adding a fragrance oil or a perfume with mixing to the aqueous uniform dispersion of step (b) to form a homogeneous dispersion of said fragrance oil or perfume in the water phase;

(d) adding a nonionic emulsifier with mixing to the homogenous dispersion of step (c) to emulsify said fragrance oil or perfume; and (e) adding a basic solution with mixing to the homogeneous dispersion of step (d) in an amount sufficient to at least partially neutralize the polyacrylic acid and to sufficiently thicken the composition.

The present invention is predicated on several unexpected discoveries: principally, (1) that a stable fragrance-containing gel can be prepared in accordance with the invention, which gel remains stable upon addition to and mixing with a fragrance-free homogeneous structured liquid detergent composition; and (2) that the resultant fragrance-containing structured detergent composition remains stable and pourable and is capable of effectively delivering perfume to washed fabrics such that the intensity and longevity of fragrance upon washed fabrics is significantly enhanced as compared to laundering with an otherwise identical composition containing the same level (percentage) of fragrance, but in the absence of said fragrance-containing gel.

The term "perfume" as used herein refers to odoriferous materials which are able to provide a pleasing fragrance to fabrics, and encompasses conventional materials commonly used in detergent compositions to counteract a malodor in such compositions and/or provide a pleasing fragrance thereto. The perfumes are preferably in the liquid state at ambient temperature, although solid perfumes are also useful. Included among the perfumes contemplated for use herein are materials such as aldehydes, ketones, esters and the like which are conventionally employed to impart a pleasing fragrance to liquid and granular deterent compositions. Naturally ocurring plant and animal oils are also commonly used as components of perfumes. Accordingly, the perfumes useful for the present invention may have relatively simple compositions or may comprise complex mixtures of natural and synthetic chemical components, all of which are intended to provide a pleasant odor or fragrance when applied to fabrics. The perfumes used in detergent compositions are generally selected to meet normal requirements of odor, stability, price and commercial availability. The term "fragrance" is often used herein to signify a perfume itself, rather than the aroma imparted by such perfume.

The term "structured liquid detergent composition" as used herein refers to detergent compositions in which the aqueous base, the detergent active material (surfactant) and electrolyte form a structuring system with solid suspending properties while remaining pourable. One particular form of such a structuring system is where the detergent active materials are dispersions of lamellar droplets in an aqueous phase which contains a building electrolyte. These lamellar droplets are often referred to as an onion-like configuration or layering of surfactant molecules. A more complete description of structured liquid detergents may be found in the publication "Liquid Detergents" by J. C. van de Pas et al., Tenside Surf. Det. 28 (1991) at pages 158–162, the disclosure of which is incorporated herein by reference.

Structured liquid detergent compositions are typically opaque (non-transparent) compositions containing electrolyte builders, one or more surfactants in the form of a multi-lamellar structure (or a layering of surfactant molecules), and which compositions are highly viscous at room temperature, typical, Brookfield viscosities being in the range of about 1,000–25,000 centipoise. In contrast thereto, unstructured liquid detergent compositions are generally clear thin liquids consisting of micellar solutions and having Brookfield viscosities at room temperature of typically from about 50 to 250 centipoise.

Typical structured and unstructured liquid compositions are shown below:

| Component | Structured Detergent Composition | Unstructured Detergent Composition |
|---|---|---|
| NaLAS[(1)] | 12.5 wt % | 12.5 wt % |
| NaAEOS[(2)] | 2.5 | 2.5 |
| Sodium Carbonate | 6.0 | — |
| Sodium tripolyphosphate | 15.0 | — |
| Water | balance to 100% | balance to 100% |
| Viscosity, cP | 2660 | 40 |

[(1)]NaLAS refers to sodium linear alkyl benzene sulfonate.
[(2)]NaAEOS refers to sodium alcohol ethoxy sulfate.

The stuctured liquid detergent compositions of the invention generally have viscosities at room temperature ranging from about 9,000 to 25,000 cp, preferably from about 12,000 to 20,000 cp, and most preferably from about 15,000 to 20,000 cp.

The term "partially neutralized" as used herein in connection with the polyacrylic acid polymer refers to compositions with pH of about 4.5. Compositions with pH of 7.0 or above are fully neutralized.

DETAILED DESCRIPTION OF THE INVENTION

Structured liquid detergent compositions in accordance with the invention generally contain by weight (a) from about 10% to about 20% of an alkyl benzene sulfonate anionic surfactant; (b) from about 1% to about 5% of an alkyl alcohol ethoxy sulfate; and (c) from about 10% to about 30% of a detergent builder or a mixture of builders selected from the group consisting of alkali metal polyphosphates; alkali metal carbonates and/or bicarbonates; and zeolite-type aluminosilicate builders.

The anionic class of surfactants generally useful for the structured liquid detergent compositions of the invention include the water-soluble sulfated and sulfonated detergents having an aliphatic, preferably an alkyl radical containing from about 8 to 26, and preferably from about 12 to 22 carbon atoms. Examples of the sulfonated anionic detergents are the higher alkyl aromatic sulfonates such as the higher alkyl benzene sulfonates containing from about 10 to 16 carbon atoms in the higher alkyl group in a straight or branched chain, such as, for example, the sodium, potassium and ammonium salts of higher alkyl benzene sulfonates, higher alkyl toluene sulfonates and higher alkyl phenol sulfonates.

Other suitable anionic detergents are sulfated ethoxylated higher fatty alcohols of the formula $RO(C_2H_4O)_mSO_3M$, wherein R is a fatty alkyl of from 10 to 18 carbon atoms, m is from 2 to 6 (preferably having a value from about ⅕ to ½ the number of carbon atoms in R) and M is a solubilizing salt-forming cation, such as an alkali metal, ammonium, lower alkylamino or lower alkanolamino. The proportion of ethylene oxide in the polyethoxylated higher alkanol sulfate is preferably 2 to 5 moles of ethylene oxide groups per mole of anionic detergent, with three moles being most preferred, especially when the higher alkanol is of 11 to 15 carbon atoms. A preferred polyethoxylated alcohol sulfate detergent is marketed by Shell Chemical Company as Neodol 25-3S.

The most highly preferred water-soluble anionic detergent compounds are the ammonium and substituted ammonium (such as mono, di and tri ethanolamine), alkali metal (such as, sodium and potassium) and alkaline earth metal (such as, calcium and magnesium) salts of the higher alkyl benzene sulfonates, olefine sulfonates and higher alkyl sulfates. Among the above-listed anionics, the most preferred are the sodium linear alkyl benzene sulfonates (LABS), and especially those wherein the alkyl group is a straight chain alkyl radical of 12 or 13 carbon atoms.

The builder materials for the structured liquid detergent compositions of the invention include alkali metal phosphates, such as alkali metal polyphosphates and pyrophosphates, including alkali metal tripolyphosphates; alkali metal carbonates; alkali metal bicarbonates; alkali metal sesquicarbonates (which may be considered to be a mixture of alkali metal carbonates and alkali metal bicarbonates); and zeolites, preferably hydrated zeolites, such as hydrated Zeolite A, Zeolite X and Zeolite Y; and mixtures of individual builders within one or more of such types of builders. Preferably the builders will be sodium salts and will also be inorganic. A highly preferred non-phosphate mixed water soluble and water insoluble builder composition comprises carbonate, bicarbonate and zeolite builders. Phosphate-containing builder systems will usually be based on alkali metal (sodium) tripolyphosphate.

Zeolite A-type aluminosilicate builder, usually hydrated, with about 15 to 25% of water of hydration is advantageous for the present invention. Hydrated zeolites X and Y may be useful too, as may be naturally occurring zeolites that can act as detergent builders. Of the various zeolite A products, zeolite 4A, a type of zeolite molecule wherein the pore size is about 4 Angstroms, is often preferred. This type of zeolite is well known in the art and methods for its manufacture are described in the art such as in U.S. Pat. No. 3,114,603.

The zeolite builders are generally of the formula $$(Na_2O)_x \cdot (Al_2O_3)_y \cdot (SiO_2)_z \cdot {}_wH_2O$$

wherein x is 1, y is from 0.8 to 1.2, preferably about 1, z is from 1.5 to 3.5, preferably 2 or 3 or about 2, and w is from 0 to 9, preferably 2.5 to 6. The crystalline types of zeolite which may be employed herein include those described in "Zeolite Molecular Series" by Donald Breck, published in 1974 by John Wiley & Sons, typical commercially available zeolites being listed in Table 9.6 at pages 747–749 of the text, such Table being incorporated herein by reference.

The zeolite builder should be a univalent cation exchanging zeolite, i.e., it should be aluminosilicate of a univalent cation such as sodium, potassium, lithium (when practicable) or other alkali metal, or ammonium. A zeolite having an alkali metal cation, especially sodium, is most preferred, as is indicated in the formula shown above. The zeolites employed may be characterized as having a high exchange capacity for calcium ion, which is normally from about 200 to 400 or more milligram equivalents of calcium carbonate hardness per gram of the aluminosilicate, preferably 250 to 350 mg. eg./g., on an anhydrous zeolite basis.

The Frayrance-Containing Gel

The fragrance-containing gel of the present invention is the vehicle by which fragrance is introduced into a stable fragrance-free homogeneous structured liquid detergent composition under conditions of relatively light shear. The starting material in the formation of such gel is a mixture of water and an insoluble polyacrylate polymer to form a hydrogel. The formation of a hydrogel, or water-containing gel based on a methacrylic or acrylic ester or acid is preferred for the present invention. The average particle size of the hydrogel is generally below about 1 mm for purposes of maintaining the stability of the hydrogel when perfume is dispersed therein. These preferred classes of hydrogels are described in "Encyclopedia of Polymer Science and Engineering", vol. 7, John Wiley & Sons (1987). At pages 783–806, the disclosure of which is incorporated herein by reference. The polymers, which can be used, are usually the polyacrylate resins such as Pemulen 1621, Carbopol 614 or Carbopol 940 or 624 sold by B.F. Goodrich (Cleveland, Ohio). Polyacrylate resins are also available from other companies such as R.I.T.A. of Woodstock, Ill. (trade name: Acrytamer) and 3-V Chemical of Weehawken, N.J. (trade name: Polygel). The Carbopol 600 and 900 series resins are hydrophilic high molecular weight, cross-linked linear acrylic acid polymers having an average equivalent weight of 76, and the general structure illustrated by the following formulas:

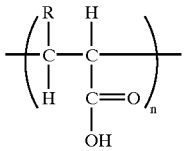

wherein R can be hydrogen or an alkyl chain. Carbopol 941 has a molecular weight of about 1,250,000; Carbopol 940 has a molecular weight of approximately 3,000,000. The Carbopol 900 series resins are highly branched chained and highly cross-linked with polyalkenyl polyether, e.g., about 1% of a polyalkyl ether of sucrose having an average of about 5.8 allyl groups for each molecule of sucrose. The preparation of this class of cross-linked carboxylic polymers is described in U.S. Pat. No. 2,798,053, the disclosure of which is incorporated herein by reference. Further detailed information on the Carbopol 900 series is available from B.F. Goodrich, see, for example, the B.F. Goodrich catalog. GC-67, Carbopol® Water Soluble Resins.

In general these thickening resins are preferably water dispersible copolymers of an alpha-beta monoethylenically unsaturated lower aliphatic carboxylic acid cross-linked with a polyether of a polyol selected from oligo saccharides, reduced derivatives thereof in which the carboynl group is converted to an alcohol group and pentaerythritol, the hydroxyl groups of the polyol which are modified being etherified with allyl groups, there being prefereably at least two such allyl groups per molecule.

The Carbopol 600 series resins are high molecular weight, non-linear moderate branched chain polyacrylic acid and are cross-linked with polyalkenyl ether. In addition to the non-linear or branched nature of these resins, they are also believed to be more highly cross-linked than the 900 series resins and have molecular weights between about 1,000,000 and 4,000,000.

The most preferred type of polymer for this invention is the hydrophobically modified cross-linked polyacrylate such as Pemulen. Pemulen polymers are generally referred to herein as polyacrylates (or polyacrylic acids), since they are interpolymers of monomeric mixtures consisting of carboxylic acid monomers such as acrylic acid, maleic acid or maleic anhydride and acrylic ester monomers with a fatty chain. The Pemulen (such as 1621, TR-1 and TR-2) type polymers are cross-linked high molecular weight hydrophobically modified polyacrylates. A qualitative estimate suggests a molecular weight of over 4 billion. The preparation of these types of hydrophobically modified polyacrylates is more fully described in patent application EP0268164 B1, U.S. Pat. 4,509,949, U.S. Pat. No. 3,915,921, U.S. Pat. No. 4,686,254, U.S. Pat. No. 5,004,598 and U.S. Pat. No. 5,585,104 the disclosures of which are incorporated by reference. The method of preparation consists of polymerizing a predominant amount of olefinically unsaturated carboxylic acid monomer or its anhydride with a smaller amount of acrylic ester monomer having a fatty chain. The preferred carboxylic monomers are the monoolefinic acrylic acids having the general structure:

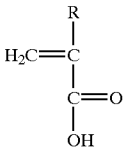

wherein R is a substituent selected from the group consisting of hydrogen, halogen, hydroxyl, lactone, lactam and the cyanogen groups, monovalent alkyl radicals, monovalent aryl radicals, monovalent aralkyl radicals, monovalent alkaryl radicals and monovalent cycloaliphatic radicals. Of this class, acrylic acid itself is the most preferred. The preferred acrylic ester monomers having long chain aliphatic groups are derivatives of acrylic acid represented by the formula:

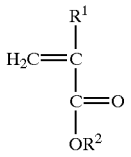

wherein $R^1$ is selected from hydrogen, methyl and ethyl groups and $R^2$ is selected from alkyl groups having from 8 to 30 carbon atoms and oxyalkylene and carbonyloxyalkylene groups, preferably alkyl groups of 10 to 22 carbon atoms. The copolymers can optionally be crosslinked preferably using a crosslinking agent polyalkenyl polyether (having more than one alkenyl ether grouping per molecule) used in an amount ranging from 0.1 to 4%, preferably from 0.2 to 1% by weight with respect to the total weight of carboxylic acid monomers and of acrylic ester monomers. The crosslinking agent can be chosen from polymerizable monomers comprising a polymerizable $CH_2{=}C$ group and at least one other polymerizable group, the unsaturated bonds of which are not conjugated with respect to one another.

Perfume is introduced into the hydrogel in the presence of a nonionic surfactant to emulsify the perfume in the water phase. Gelation of the resultant mixture occurs upon addition of a base such as sodium hydroxide (or organic bases such as amines). After base neutralization (partially or full neutralization) a viscoelastic gel is formed with suspended droplets of perfume or fragrance.

The fragrance-containing gel is typically comprised of from about 0.1 to about 2 wt % polymer; from about 0.1 to about 2 wt % nonionic surfactant; from about 1 to about 30 wt % perfume and balance water.

Suitable nonionic surfactants to effect emulsification of the perfume include, reaction products of compounds having a hydrophobic group and a reactive hydrogen atom, for example aliphatic alcohols, acids, amides and alkyl phenols with alkylene oxides, especially ethylene oxide, either alone or with propylene oxide. Specific nonionic surfactant compounds are alkyl ($C_6$–$C_{18}$) primary or secondary linear or branched alcohols condensed with ethylene oxide, and products made by condensation of ethylene oxide with the reaction products of propylene oxide and ethylenediamine. Preferred nonionic surfactant compounds are those of the ethoxylated and mixed ethoxylated-propyloxylated ($C_6$–$C_{18}$) fatty alcohol type, containing 2–11 EO groups.

A particularly effective nonionic surfactant for purposes of forming a stabilized fragrance-containing hydrogel is a water-soluble triblock copolymer comprising groups of polyethylene oxide and propylene oxide having the following structural formula:

(I) $A_x B_y A_z$ or (II) $B_x A_y B_z$ wherein A is a polyethylene oxide group, B is a polypropylene oxide group and each of x, y and z is a number within the range of from one to about 85, the molecular weight of the triblock copolymer being in the range of from about 1,000 to about 15,000 and the percentage, by weight, of polyethylene oxide in said triblock copolymer is from about 10 to about 80% of the molecular weight of the copolymer. These triblock copolymers are commercially available and are marketed, for example, by BASF Corporation under the trademark Pluronic®. A description of the preparation of these compounds is set forth in U.S. Pat. No. 2,674,619, the disclosure of which is incorporated herein by reference.

Preferred triblock copolymers for use herein are those wherein the weight of polyethylene oxide is from about 10% to about 80%, and most preferably from about 40% to about 80%, by weight, of the triblock copolymer. The average molecular weight of the copolymer is most usefully within the range of from about 1,100 to about 8,400.

ANALYTICAL METHODS

1. Heated SPME Head Space Analysis of Dry Fabric

Solid phase microextraction (SPME; Almirall, J. R.; Furton, K. G. In Solid Phase Microextraction; A Practical Guide; Scheppers-Wercinski, S., Ed; Marcel Dekker; New York, 1999, pp. 203–216) is a solventless extraction technique through which analytes are extracted from a matrix (such as fabric) into a polymer or other phase, coated on a fused silica fiber. The SPME is coupled with gas chromatography (GC) for desorption and analyses of the analytes.

Materials:

1. Gas Chromatograph with Ion Trap Mass Spec detection and SPME 0.75 mm ID inlet liner. (Varian GC3800/Saturn 2000 equipped with 8200 SPME Auto Sampler with Agitation and DBS Autotherm 12 sample Carousel.
2. GC column: CP-SIL-8CB-MS, 30 m×0.25 mm×0.25 μm.
3. SPME Fiber: 100 μm polydimethlysiloxane (Supelco 57300-U (manual) or 57301 (automated))
4. 10 ml Head Space Vials with crimp top and 20 mm VITON septa (Supelco 27386 and 27245)

Method:

1. Using clean dry scissors, cut (3) 1 gram swatches from the terry cotton towel to be analyzed.
2. Using a glass rod insert each swatch into a 10 ml head space vial, being careful to insert far enough to not damage SPME fiber.
3. Cap vials and allow to equilibrate at room temperature for at least 24 hours.
4. Equilibrate vials at 50° C. for at least 45 minutes
5. Insert fiber and expose for 20 minutes at 50° C.
6. Inject into Gas chromatograph and desorb for 30 minutes at 250° C.

GC Conditions:

| Injector Temperature: | | 250° C. |
|---|---|---|
| Column Flow: | | 1 mL/min |
| | Column Oven: | |
| Temp (° C.) | Rate (C/min) | Hold (min) |
| 50 | 0 | 5 |
| 200 | 5 | 5 |
| 220 | 5 | 1 |
| | Total run time: 45 minutes | |

SPME analysis was also performed employing similar method using the following system:

Instrument: GC (Varian Star 3400 CX)/Satum 2000 MS

Column: Supelcowax (TM) 10 fused silica capillary column. 30 m×0.25 mm×0.25 mm film thickness, Mfg. under HP U.S. Pat. No. 4,293,415.

Fiber: Supelco SPME Fiber Assembly, 100 um Polydimethylsiloxane Coating (57300-Manual Holder).

The analysis was performed by equilibrating the sample at 50° C. for 30 min and exposing the fiber for 30 min.

Method:

1. Using clean dry scissors, cut (3) 1 gram swatches from the terry cotton towel to be analyzed.
2. Using a glass rod insert each swatch into a 10 ml head space vial, being careful to insert far enough to not damage SPME fiber.

3. Cap vials and allow to equilibrate at room temperature for at least 24 hours and then at 50° C. for 30 minutes.
5. Insert fiber and expose for 30 minutes at 50° C.

GC Conditions:

| | |
|---|---|
| Injector: | 250° C. |
| Column Flow: | 1 mL/min |
| Initial Column Temperature = | 50° C. |
| Initial Column Hold Time = | 2 min |
| Final Temperature = | 200° C. |
| Rate = | 5° C./min |
| Hold Time at Final Temperature = | 8 min |
| Total run time: | 45 min |

2. Fragrance Intensity Discrimination Panel

The objective of the Fragrance Intensity panel is to assess the relative Intensity of fragrance deposited by various detergents on dry towels. The study is implemented as a double-blind, sequential monadic evaluation, counter balanced for initial presentation of each test product. Each panelist evaluates towels washed in test products, dried and left hanging for 1, 3 and/or 7 days in a controlled environment. Subjects complete sequential monadic ratings on each product in a fragrance booth and rate the intensity of the odor on a 7-point scale:

1. no odor
2. just detectable
3. weak
4. moderate
5. slightly strong
6. intense
7. very intense Subjects evaluate the fragrance of products on one dry Terry towel (four Terry hand towels per one covered glass container), taken from within a glass container within a fragrance booth. Subjects must wear gloves when handling sample towels. Ventilation is on in the booth. Only a 3-digit code number identifies samples. Following evaluation of the first sample, the panelists proceed to the second booth for evaluation of the second sample. Panelists sniff a tissue and rest one minute (timed) between booths. Two sessions are run for this kind of analysis (one in the morning and one in the afternoon). After evaluation of the towel, it is placed in a plastic bag and removed from the booth and away from the booth. One towel for each product is evaluated by each panelist in the appropriate booth in the order prescribed by the randomization schedule.

3. Stripping Procedure for Terry Towels

For all sample evaluations 24 new hand Terry towels (86% Cotton, 14% Polyester) were prepared in a 17 gallon top loading washing machine set for hot wash (120° F.), with extra large setting, in tap water. Two wash cycles with 100 g fragrance free Mexican Viva 2 powder detergent, one wash with water only, extra rinse switch was on, was used for all washes. After all three wash cycles were over, the towels were dryer dried in an electric clothes dryer, and laid flat for storage. All fabric ballast used for the tests was processed the same way as towels between each use.

EXAMPLES

Example I

Detailed Preparation of a Fragrance Containing Gel. A fragrance gel was prepared by mixing the following ingredients, which are given in weight parts:

| | Fragrance Gel-1 |
|---|---|
| Demineralized Water | 93.83 |
| Pemulen 1621[(2)] | 0.51 |
| Fragrance[(1)] | 5 |
| Pluronic L64[(3)] | 0.58 |
| 38% $Na_2O$ Caustic Solution | 0.08 |

[(1)]Dynacare 492 (IFF)
[(2)]Hydrophobically modified, high MW polyacrylates sold by B.F. Goodrich
[(3)]Water-soluble triblock copolymer comprising groups of polyethylene oxide and polypropylene oxide marketed by BASF Corporation.

The above gel was prepared by sprinkling the Pemulen polymer into rapidly agitated water at room temperature until a uniform dispersion was obtained. Fragrance oil was added to the aqueous polymer dispersion and mixed until a homogenous dispersion of the fragrance in the aqueous phase was obtained. The emulsifier Pluronic L64 was added at this point and mixed thoroughly. At the final step, sodium hydroxide solution was added and the resulting gel was well mixed.

The gel exhibited a Brookfield viscosity (at room temperature, spindle 4, 12 RPM) of about 31000 cP and a pH of about 4.85. In general, viscosity will vary depending upon the quality of water and the amount of the neutralizing agent.

Preparation of Structured Liquid Detergent Base (Base 1). A structured liquid detergent base was prepared by mixing the following ingredients, which are given in weight parts:

| | Base 1 |
|---|---|
| Water | 64 |
| Sodium $C_{12}$–$C_{13}$ Linear Alkyl Benzene Sulfonate (LAS) | 12.5 |
| Sodium $C_{12}$–$C_{14}$ Alcohol Ethoxy (3EO) Sulfate (AEOS) | 2.5 |
| $Na_2CO_3$ | 6 |
| Sodium tripolyphosphate, NaTPP | 15 |

The following general procedure was used in the preparation of the Base 1:

Part 1

1. Weigh out water, use double bladed stirrer (stem length about 12 inches; 3 prong, each prong length about 1¾ inches; width of about 9/16 inches).
2. Add soda ash, mix until clear.
3. Add NaTPP "spoonwise", slowly to water while mixed at about 175 RPM. Take approximately 45 min to add all TPP.

Part 2

4. In separate container, thoroughly mix the LAS and AEOS. Mix 1.5 times more than necessary the total amount required for each surfactant. Mix for at least 1 hour making sure that both surfactants intermix thoroughly. Use Paddle type stirrer (13 and ¾ inches long stem, Paddle dimensions about 2¾ inches length and width; 6 spherical holes with ½ inch diameter each).

Mixing of Part 1 and Part 2

5. Add surfactant mixture slowly to part 1 solution. Take approximately 30 min to 45 min to add all surfactant. Mix at 300–350 RPM. Continue stirring total mixture for another 1 hour.

Preparation of Structured Liquid Detergent With Fragrance. The following compositions (Samples 1 and 2, respectively) were prepared employing the Base detergent by post adding equivalent amounts of fragrance either by the addition of fragrance or the Fragrance Gel (amounts are shown in weight parts):

| | Sample 1 | Sample 2 |
|---|---|---|
| Base | 89.3 | 89.3 |
| Fragrance[1] | 0.54 | — |
| Fragrance Gel-1 | — | 10.7 |
| Water | 10.16 | — |

[1]Dynacare 492 (IFF)

After post-addition of the fragrance or the fragrance gel, the detergent dispersions were mixed thoroughly. In the case of Sample 1 both fragrance and water were post added.

Washing Protocol # of washes and detergent dosage:

3 washes @ 114 g detergent for the 2 samples

Conditions:

US machines (Whirlpools); 57 L setting; 25° C. wash temperature; 50 ppm water hardness Load: 4.2 Lb of fabric load total [1.5 Lb cotton terry hand towels plus 2.7 Lb ballast (2 pillowcases, 1 nylon slip, 1 dress shirt 65/35, 4 cotton T-shirts, 1 towel 86/4, 1 dress shirt 100% polyester)

Wash Procedure:

1. Allow machine to fill completely
2. Add detergent; let agitate a few seconds to mix; add fabric load
3. Allow machine to complete cycle After completion of appropriate number of wash cycles (total 3), remove hand towels and dry in constant 40% RH humidity room for aging (24 h, 3 days or 7 days). Towels are then evaluated by SPME method and/or by fragrance panel. The results are shown in Table 1.

TABLE 1

Sensory evaluation data on dry fabric (24 h dry).

| | Sample 1 | Sample 2 | P-value |
|---|---|---|---|
| Rate Fragrance Intensity (1–7) | 3.0[B] | 3.5[A] | 0.137 |

Note:
Results are from Tukey's Studentized Range Test. Means with different letters are significantly different at 90% CL.

A sensory evaluation of fragrance intensity on dry cloth after 24 h by panelists indicates a significant win over the control (Sample 1) for the composition of the invention based on hydrophobically modified polyacrylate (Pemulen 1621) Gel (Sample 2). Panelists perceived a product with polyacrylate gel to deliver a higher level of fragrance on dry cloth even though the fragrance level in the two products was the same.

Another sensory evaluation experiment indicated a longer lasting benefit when using the fragrance gel of the invention. In a paired comparison, test results indicated that detergent with fragrance gel was significantly better in delivering perceived fragrance than the control (which did not contain fragrance gel) at 24 h dry and 48 h dry sensory evaluations.

Example II

Detailed Preparation of Fragrance Containing Gels. Fragrance gels were prepared by mixing the following ingredients, which are given in weight parts:

| | Fragrance Gel-2 | Fragrance Gel-3 |
|---|---|---|
| Pemulen 1621 | 0.51 | 0.51 |
| Fragrance[1] | 5.00 | 9.99 |
| Pluronic L64 | 0.58 | 0.89 |
| 1 M NaOH | 1.02 | 1.02 |
| Demineralized Water | 92.90 | 87.59 |

[1]Dynacare 492 (IFF)

The above gels were prepared by sprinkling the Pemulen polymer into rapidly agitated water at room temperature until a uniform dispersion was obtained. Fragrance oil was added to the aqueous polymer dispersion and mixed until a homogenous dispersion of the fragrance in the aqueous phase was obtained. The emulsifier Pluronic L64 was added at this point and mixed thoroughly. At the final step, sodium hydroxide solution was added and the resulting gel was well mixed.

Preparation of Structured Liquid Detergent Base (Base 1). A structured liquid detergent base (Base 1) was prepared by the procedure given in Example I.

Preparation of Structured Liquid Detergent With Fragrance. Compositions corresponding to Samples 3, 4 and 5 were prepared employing the Base detergent by post adding equal amounts of fragrance by addition of either fragrance or the Fragrance Gel (amounts are shown in weight parts):

| | Sample 3 | Sample 4 | Sample 5 |
|---|---|---|---|
| Base 1 | 89.28 | 89.28 | 89.28 |
| Fragrance[1] | 0.54 | — | — |
| Fragrance Gel-2 | — | 10.7 | — |
| Fragrance Gel-3 | | | 5.36 |
| Water | 10.18 | — | 5.36 |

[1]Dynacare 492 (IFF)

After post-addition of the fragrance or the fragrance gel, the detergent dispersions were mixed thoroughly. In case of Sample 3, both fragrance and water were post added.

Washing Protocol

Terg-O-Tometer 33.42 g of fabric load (Terry Towels); 2 g detergent for 1L water in a bucket

25° C.

Water hardness of 50 ppm.

Washing Time of 10 min

After completion of wash, remove hand towels and dry in constant 40% RH humidity room for aging (24 h, 3 days or 7 days). Towels are then evaluated by SPME method. The results are shown in Table 2.

TABLE 2

Analytical Data on Dry Fabric (24 h) by Solid Phase Microextraction Method.

| | Total Fragrance Counts (Standard Deviation)* |
|---|---|
| Sample 3 | 423124 (107361) |
| Sample 4 | 929612 (357633) |
| Sample 5 | 824898 (238013) |

*Average of 4 runs. Average of the following fragrance components: Galaxolide, Iso E Super and Hexyl Salicylate.

Table 2 indicates that detergent samples (4 and 5) containing the fragrance gel significantly improve the fragrance deposition onto the Terry towels.

Example III

Preparation of an Unstructured Liquid Detergent Base (Base 2). An unstructured liquid detergent base was prepared by mixing the following ingredients, which are given in weight parts:

| Ingredient | Weight Parts |
|---|---|
| Nonionic surfactant (Alcohol ethoxylate; 7EO)[(1)] | 8 |
| Sodium $C_{12}$–$C_{13}$ Linear Alkyl Benzene Sulfonate | 8.3 |
| Sodium $C_{12}$–$C_{14}$ Alcohol Ethoxy (3EO) Sulfate | 2 |
| Optical Brightener | 0.15 |
| Sodium Silicate | 2 |
| Ethanol | 2 |
| Formalin | 0.25 |
| Water | To 100 |

[(1)]Sold by Huntsman as L24-7

A Fragrance Gel (4) of the following composition was prepared following the procedure of Example I:

| Ingredient | Weight Parts |
|---|---|
| Pemulen 1621 | 0.51 |
| Fragrance[1] | 10 |
| Pluronic L64 | 0.89 |
| 1 M NaOH | 1.02 |
| Deionized Water | To 100 |

[1]Dynacare 492 (IFF)

Preparation of Unstructured Liquid Detergent With Fragrance. Compositions corresponding to Examples 6 and 7 were prepared with the Base 2 detergent by post adding either the fragrance (and water) or the Fragrance Gel 4 (amounts are shown in weight parts):

| | Sample 6 | Sample 7 |
|---|---|---|
| Unstructured Liquid Detergent Base 2 | 89.3 | 89.3 |
| Fragrance Gel 4 | — | 5.35 |
| Fragrance[(1)] | 0.54 | |
| Deionized Water | 10.16 | 5.35 |

[(1)]Dynacare 492 (IFF)

Washing Conditions:

46.1 g of fabric load (100% cotton Terry Towels)/1L water 2 g detergent/1L water Temperature=25° C.

Water Hardness=100 PPM

Washing Time=10 min in a Tergotometer

After washing the fabrics were air dried for 24 h and then placed into the vials for SPME (solid phase microextraction method) analysis.

Table 3. Analytical Data on Dry Fabric (24 h) by Solid Phase Microextraction Method (Samples 6 and 7).

| | Total Fragrance Counts* |
|---|---|
| Sample 6 | 788489 |
| Sample 7 | 723382 |

*Average of 4 runs. Average of the following fragrance components: Galaxolide, Celestolide, Hexyl Cinnamic Aldehyde, Iso E Super, Hexyl Salicylate, Lilial, and Cedryl Acetate.

Table 3 demonstrates that both samples of the unstructured liquid detergent compositions, namely, Sample 6 which contained fragrance but not a fragrance gel, and Sample 7 which contained a fragrance gel, delivered about equal amounts of fragrance to the fabric surface. This is in marked contrast to Example II which used a structured liquid detergent base, and wherein the addition of a fragrance gel in accordance with the invention to such detergent base resulted in significantly improved fragrance delivery to the fabric surface relative to that provided by the control composition which did not contain a fragrance gel. Accordingly, the fragrance containing gel described herein is preferably used in combination with a homogeneous structured liquid detergent composition for optimum deposition and retention of fragrance upon the laundered fabrics.

Example IV

The Importance of Preemulsification of Perfume

Detailed Preparation of Fragrance Containing Gels. Fragrance gels were prepared by mixing the following ingredients, which are given in weight parts:

| | Gel-5 | Fragrance Gel-6 |
|---|---|---|
| Pemulen 1621 | 0.51 | 0.51 |
| Fragrance[1] | 0.00 | 5.00 |
| Pluronic L64 | 0.58 | 0.58 |
| 1 M NaOH | 1.02 | 1.02 |
| Demineralized Water | 97.90 | 92.90 |

[1]Dynacare 492 (IFF)

The above gels were prepared by sprinkling the Pemulen polymer into rapidly agitated water at room temperature until a uniform dispersion was obtained. Fragrance oil was added to the aqueous polymer dispersion and mixed until a homogenous dispersion of the fragrance in the aqueous phase was obtained. The emulsifier Pluronic L64 was added at this point and mixed thoroughly. At the final step, sodium hydroxide solution was added and the resulting gel was well mixed.

Preparation of Structured Liquid Detergent Base (Base 1). A structured liquid detergent Base 1 was prepared by following the procedure of Example I.

Preparation of Structured Liquid Detergent With Fragrance. Compositions corresponding to Samples 8, 9, 10 and 11 were prepared with the Base 1 detergent by adding fragrance, Gel-5 or Fragrance Gel-6 and water in the amounts shown in weight parts.

| | Sample 8 | Sample 9 | Sample 10 | Sample 11 |
|---|---|---|---|---|
| Base 1 | 88.81 | 88.81 | 88.81 | 88.81 |
| Fragrance[1] | — | 0.53 | 0.53 | — |
| Gel-5 | — | — | 10.66 | — |

-continued

| | Sample 8 | Sample 9 | Sample 10 | Sample 11 |
|---|---|---|---|---|
| Fragrance Gel-6 | | — | — | 10.66 |
| Water | 11.19 | 10.66 | — | 0.53 |

[1]Dynacare 492 (IFF)

After post-addition of the fragrance or the fragrance gel, the detergent dispersions were mixed thoroughly.

Washing Protocol

Terg-O-Tometer 33.42 g of fabric load (Terry Towels); 2 g detergent for 1L water in a bucket

25° C.

Water hardness of 50 ppm.

Washing Time of 10 min

After completion of wash, remove hand towels and dry in constant 40% RH humidity room for aging (24 h, 3 days or 7 days). Towels are then evaluated by SPME method. The results are shown in Table 4.

TABLE 4

Analytical Data on Dry Fabric (24 h) by Solid Phase Microextraction Method.

| | Total Fragrance Counts |
|---|---|
| Sample 9 | 34866 |
| Sample 10 | 35883 |
| Sample 11 | 43647 |

*Average of 3 runs. Average of the following fragrance components: benzyl acetate, nerol, geraniol, methyl ionone, lilial, and Iso E Super.

Table 4 demonstrates that the presence of Pemulen polymer gel which is formed in the absence of fragrance and which is not in accordance with the invention (Sample 10) does not result in enhanced fragrance delivery relative to the control (Sample 9). For enhanced fragrance delivery, the fragrance must be emulsified by the polymer (in accordance with the invention (Sample 11) prior to addition to the structured liquid detergent.

Example V

Demonstration of the Importance of the Nonionic Emulsifier in Preparing the Fragrance Gel. Gel-7 in accordance with the invention was prepared using the procedure shown in Examples I–IV. Gel-8 was prepared following the same procedure as for Gel-7 except it did not contain the emulsifier Pluronic L64 and, hence, is outside the invention.

| | Gel-7 | Gel-8 |
|---|---|---|
| Pemulen 1621 | 0.498 | 0.498 |
| Fragrance[1] | 6.989 | 6.989 |
| Pluronic L64 | 0.568 | — |
| 1 M NaOH | 0.98 | 0.98 |
| $H_2O$ | 90.965 | 90.397 |

[1]Dynacare 492 (IFF)

Following its preparation, Gel-7 remained stable over time while Gel-8 separated into different phases.

The fragrance containing gel of the invention may be used to advantage not only for enhanced fragrance deposition onto laundered fabrics as herein described, including use in fabric softening compositions but may also be used to provide on-skin fragrance longevity when used in personal care products such as hair shampoos, hair treatments, shower gel compositions, liquid hand soaps, creams and lotions. In preparing the gels it will be recognized that one can replace the fragrance with flavor oils. Flavor oils such as methyl salicylate, for example, are used in toothpastes. Flavor oils can be protected in toothpaste products for a longer period of time and their delivery to the tooth surface can also be enhanced with the use of the gel herein described.

What is claimed is:

1. A stable fragrance-containing gel capable of being mixed with a fragrance-free base composition comprised of a homogeneous aqueous structured liquid detergent composition to form a pourable fragrance-containing homogeneous aqueous structured detergent composition which is characterized by being able to provide enhanced deposition and retention of said fragrance upon fabrics laundered with such fragrance-containing detergent composition as compared to laundering with an otherwise identical composition containing the same level of fragrance but in the absence of said fragrance-containing gel, said fragrance-containing gel consisting essentially of:

(a) a cross-linked polyacrylic acid polymer having an average particle size below about 1 mm;

(b) water in an amount sufficient to form a gel with said polymer;

(c) a fragrance dispersed within said gel; and (d) a nonionic surfactant in an amount sufficient to emulsify said fragrance and enhance its dispersion within said gel to provide a stable fragrance-containing gel.

2. A fragrance-containing gel as in claim 1 wherein said gel has dispersed therein substantially all the fragrance added to said base composition.

3. A fragrance containing gel as in claim 1 wherein said nonionic surfactant is a water-soluble triblock copolymer comprising groups of polyethylene oxide and polypropylene oxide having the following structural formula:

(I) $A_x B_y A_z$ or (II) $B_x A_y B_z$ wherein A is a polyethylene oxide group, B is a polypropylene oxide group and each of x, y and z is a number within the range of from one to about 85, the molecular weight of the triblock copolymer being in the range of from about 1,000 to about 15,000 and the percentage, by weight, of polyethylene oxide in said triblock copolymer is from about 10 to about 80% of the molecular weight of the triblock copolymer.

4. A fragrance-containing gel as in claim 3 wherein said triblock copolymer has a structure according to formula (I) wherein x and z are 26, y is 30 and the molecular weight of said triblock copolymer is about 2,900.

5. A fragrance-containing gel as in claim 1 wherein said polyacrylic acid polymer is a hydrophobically modified polymer.

6. A fragrance-containing gel as in claim 1 wherein said polymer is at least partially neutralized.

7. A fragrance-containing homogeneous aqueous structured liquid detergent composition which is capable of providing enhanced deposition of fragrance upon fabrics laundered with such detergent composition comprising:

(a) a homogeneous structured liquid detergent composition; and (b) a stable fragrance-containing gel consisting essentially of (i) a cross-linked polyacrylic acid polymer having an average particle size below about 1 mm; (ii) water in an amount sufficient to form a gel with said polymer; (iii)

a fragrance dispersed within said gel; and (iv) a nonionic surfactant in an amount sufficient to emulsify said fragrance and enhance its dispersion within said gel to provide a stable fragrance-containing gel, whereby said liquid detergent composition is able to provide enhanced deposition and longevity of fragrance upon laundered fabrics as compared to laundering with an otherwise identical composition containing the same level of fragrance but in the absence of said fragrance-containing gel.

8. A fragrance-containing homogeneous structured liquid detergent composition as in claim 7 wherein said gel has dispersed therein substantially all the fragrance in said liquid detergent composition.

9. A fragrance-containing homogeneous structured liquid detergent composition as in claim 7 wherein said nonionic surfactant is a water-soluble triblock copolymer comprising groups of polyethylene oxide and polypropylene oxide having the following structural formula:

(I) $A_x B_y A_z$ or (II) $B_x A_y B_z$ wherein A is a polyethylene oxide group, B is a polypropylene oxide group and each of x, y and z is a number within the range of from one to about 85, the molecular weight of the triblock copolymer being in the range of from about 1,000 to about 15,000 and the percentage, by weight, of polyethylene oxide in said triblock copolymer is from about 10 to about 80% of the molecular weight of the copolymer.

10. A fragrance-containing homogeneous structured liquid detergent composition in claim 7 wherein said triblock copolymer has a structure according to formula (I) herein x and z are 26, y is 30 and the molecular weight of said triblock copolymer is bout 2,900.

11. A fragrance-containing structured liquid detergent composition as in claim 7 wherein said polyacrylic acid polyer is at least partially neutralized.

12. A method of laundering fabrics comprising the step of contacting said fabrics with an effective amount of the aqueous structured liquid detergent composition of claim 7.

13. A method of preparing a fragrance-containing gel comprising in sequence the steps of:

(a) providing a cross-linked polyacrylic acid polymer having an average particle size below about 1 mm;

(b) adding said polyacrylic acid polymer to water with mixing to form a uniform dispersion of said polymer in water;

(c) adding a fragrance oil or a perfume with mixing to the aqueous uniform dispersion of step (b) to form a homogeneous dispersion of said fragrance oil or perfume in the water phase;

(d) adding a nonionic emulsifier with mixing to the homogenous dispersion of step (c) to emulsify said fragrance oil or perfume; and (e) adding a basic solution with mixing to the homogeneous dispersion of step (d) in an amount sufficient to at least partially neutralize the polyacrylic acid and to sufficiently thicken the composition.

* * * * *